US005722008A

United States Patent [19]

Laing

[11] Patent Number: 5,722,008

[45] Date of Patent: Feb. 24, 1998

[54] COPY MACHINE WITH PHYSICAL MIXING OF DISTINCT TONER TO FORM A CUSTOM COLORED TONER

[75] Inventor: John R. Laing, Rochester, N.Y.

[73] Assignee: Xerox Corporation, Stamford, Conn.

[21] Appl. No.: 753,133

[22] Filed: Nov. 20, 1996

[51] Int. Cl.[6] ..... G03G 15/01

[52] U.S. Cl. ..... 399/54; 399/224

[58] Field of Search ..... 399/54, 223, 224, 399/225, 258, 259

[56] References Cited

U.S. PATENT DOCUMENTS

| | | | |
|---|---|---|---|
| 4,078,929 | 3/1978 | Gundlach | 96/1.2 |
| 4,082,061 | 4/1978 | Fraser | 399/225 |
| 4,113,371 | 9/1978 | Fraser et al. | 399/226 |
| 4,731,634 | 3/1988 | Stark | 355/3 TR |
| 4,903,048 | 2/1990 | Harringrton | 346/157 |
| 4,998,144 | 3/1991 | Karn | 355/326 |
| 5,119,147 | 6/1992 | Hays | 355/326 |
| 5,121,172 | 6/1992 | Stover | 355/327 |
| 5,281,502 | 1/1994 | Brewington et al. | 430/45 |
| 5,305,070 | 4/1994 | Snelling | 355/326 R |
| 5,317,373 | 5/1994 | Bares | 355/326 R |
| 5,557,393 | 9/1996 | Goodman et al. | 355/326 R |

*Primary Examiner*—Joan H. Pendegrass
*Attorney, Agent, or Firm*—John S. Wagley

[57] ABSTRACT

A marking particle color blending device for use in an electrophotographic printing machine of the type having an electrostatic latent image recorded on a photoconductive member is provided. The device includes a first container for storing a first supply of marking particles defining a first color and a second container for storing a second supply of marking particles defining a second color. The device further includes a mixing chamber operably associated with the first container and the second container for receiving a least a portion of at least one of the first supply of marking particles and the second supply of marking particles. The device also includes a first metering device operably associated with the first container and the mixing chamber for accurately controlling the quantity of the first supply of marking particles entering the mixing chamber. The device further includes a second metering device operably associated with the second container and the mixing chamber for accurately controlling the quantity of the second supply of marking particles entering the mixing chamber.

24 Claims, 3 Drawing Sheets

COPY MACHINE WITH PHYSICAL MIXING OF DISTINCT TONER TO FORM A CUSTOM COLORED TONER

BACKGROUND OF THE INVENTION

This invention relates generally to the rendering of latent electrostatic visible using colored marking particles and, more particularly, to a developer apparatus for providing custom colored marking particles.

Development of electrostatic images is currently available through the use of a wide variety of development systems, such as, monochrome development systems which use a single color toner and no carrier; two component development systems that employ both toner and carrier materials; and three component systems that make images visible with toner, carrier and an additive.

An example of two component development is described in the concept of tri-level xerography in U.S. Pat. No. 4,078,929 issued in the name of Gundlach. The patent to Gundlach teaches the use of tri-level xerography as a means to achieve single-pass highlight color imaging. As disclosed therein, the charge pattern is developed with toner particles of first and second colors. The toner particles of one of the colors are positively charged and the toner particles of the other color are negatively charged. In one embodiment, the toner particles are supplied by a developer which comprises a mixture of triboelectrically relatively positive and relatively negative carrier beads. The carrier beads support, respectively, the relatively negative and relatively positive toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development system is biased to about the background voltage. Such biasing results in a developed image of improved color sharpness.

In tri-level xerography, the xerographic contrast on the charge retentive surface or photoreceptor is divided three, rather than two, ways as is the case in conventional xerography. The photoreceptor is charged, typically to 900v. It is exposed imagewise, such that one image corresponding to charged image areas (which are subsequently developed by charged area development, i.e. CAD) stays at the full photoreceptor potential. The other image is exposed to discharge the photoreceptor to its residual potential, (typically 100v) which corresponds to discharged area images that are subsequently developed by discharged-area development (DAD). Various techniques which have heretofore been employed to develop electrostatic images are incorporated herein by reference, as well as the references cited in them, to the extent necessary to practice the present invention.

When utilizing highlight color machines, users frequently have the need to utilize a non-standard or custom color. Colored marking particles, whether inks or toners, are typically available in primary colors. In particular, the additive colors of magenta, cyan, and yellow, which are also used for full-process color, are typically available for highlight colors. Common highly used colors, for example, red and green, may likewise be available. A particular custom color, for example, the color of a company's logo, may be a unique or customized color. Printing shops, for example, may be called upon to provide company logos of various companies with various different customized colors.

In highlight color devices, customized colors have been provided in some cases by or with provision of the custom color developer material. The enablement of users of devices for developing electrostatic images on charge retentive surfaces in a user designed color in these devices was through the use of developer material which was of that desired color.

Other techniques for obtaining a custom color include grade scaling methods which provide a differentiation in the colors of images produced such as that disclosed in U.S. Pat. No. 4,903,048. Multi-level highlight color printing machines of the type described in U.S. Pat. No. 4,731,624 to Stark permit the overlapping of certain developer materials to achieve a blended color of two (2) developer materials using a highlight color printing machine also of the type to which this invention relates. Blending of colors to form a custom color is disclosed in U.S. Pat. No. 5,557,393 to Goodman et al., the relevant portions thereof incorporated herein by reference.

Customized colors specified by the users have been a major concern, both of marketers and manufacturers of electrophotographic printers, as users thereof have demanded them. Various methods as described above, as well as others, have been employed to achieve such results. However, these methods and apparatuses used to practice these methods have not always been entirely successful, reliable, or relatively inexpensive. Thus, there exists a need for relative inexpensive and simple method and means for operators of printing machines to achieve customized colors.

The blending device of the present invention is intended to alleviate at least some of the aforementioned problems.

The following disclosures may be relevant to various aspects of the present invention:

- U.S. Pat. No. 5,317,373 Patentee: Bares Issue Date: May 31, 1994
- U.S. Pat. No. 5,305,070 Patentee: Snelling Issue Date: Apr. 19, 1994
- U.S. Pat. No. 5,281,502 Patentee: Brewington et al. Issue Date: Jan. 25, 1994
- U.S. Pat. No. 5,121,172 Patentee: Stover Issue Date: Jun. 9, 1992
- U.S. Pat. No. 5,119,147 Patentee: Hays Issue Date: Jun. 2, 1992
- U.S. Pat. No. 4,998,144 Patentee: Karn Issue Date: Mar. 5, 1991
- U.S. Pat. No. 4,903,048 Patentee: Harrington Issue Date: Feb. 20, 1990
- U.S. Pat. No. 4,731,634 Patentee: Stark Issue Date: Mar. 15, 1988
- U.S. Pat. No. 4,078,929 Patentee: Gundlach Issue Date: Mar. 14, 1978
- U.S. Pat. No. 5,557,393 Patentee: Goodman et al. Issue Date: Sep. 17, 1996

U.S. Pat. No. 5,317,373 discloses an apparatus for adjusting the forming a developed image on a photoconductive surface so as to change the quantity of at least one of the plurality of colored developer materials attracted to the photoconductive surface so that the quantity of the respective developer materials constituting the developed image is varied.

U.S. Pat. No. 5,305,070 discloses a printing machine for tri-level color images which have user selectable color. Selection of a desired color establishes the voltage bias of a plurality of developer structures which, in turn, determines how much of each color toner is deposited on a particular image.

U.S. Pat. No. 5,281,502 discloses a process for forming two color images on a printing machine. The process includes charging an image member in an imaging apparatus, creating on the member a latent image comprising areas of high, intermediate, and low potential, developing the low areas of potential with a colored developer, subsequently developing the high areas of potential with a black developer and transferring the two-colored image to a substrate.

U.S. Pat. No. 5,121,172 discloses an apparatus for producing single pass highlight and custom color images. The apparatus includes three scavangeless development housings, one with a custom color toner, one with a highlight toner color and one with a black toner. The black housing uses a negative toner polarity and the custom color and highlight color housing use a positive toner polarity.

U.S. Pat. No. 5,119,147 discloses an apparatus for selective coloring of bi-level images. An AC biased wire in self spaced contact with a toner donor roll, a belt image receiver and an array of addressable electrodes are used. The electrodes are selectively addressed to effect the development of the receiver.

U.S. Pat. No. 5,119,147 discloses a color copier having an operator interface having at least one of a plurality of colors displayed on a received color palate. Electrical signal representative of the color and the pattern are stored and can be applied to create a color palette with the same copier.

U.S. Pat. No. 4,903,048 discloses a color printer which produces a fine pattern of two different color dots. The dots blend with the background and yield a colored appearance when seen from a distance. A color image is produced by overlaying, combining or juxtapositioning a pattern from the first color with a pattern from the second color.

U.S. Pat. No. 4,731,634 discloses an apparatus for printing black and plural highlight color images in a single pass. Two of the toners are attracted to only one charge level on a charge retentive surface to supply the black and one highlight color, while two toners are attracted to another charge level to form the second highlight color.

U.S. Pat. No. 4,078,929 discloses a method for producing two color development of a xerographic charge pattern. The charge pattern of singular polarity and having at least three different levels of potential is developed in two colors by utilizing relatively negatively charged toner particles of one color and relatively positively charged particles of a second color.

U.S. Pat. No. 5,557,393 discloses a process and apparatus for achieving customer selectable colors in an electrostatographic imaging system. The process includes forming an electrostatic latent image on an image forming device, developing the image on the image forming device with at least one developer containing carrier particles and a blend of two or more compatible toner compositions and transferring the toner image to a receiving substrate and fixing it thereto.

SUMMARY OF THE INVENTION

In accordance with one aspect of the present invention, there is provided a marking particle color blending device for use in an electrophotographic printing machine of the type having an electrostatic latent image recorded on a photoconductive member. The device includes a first container for storing a first supply of marking particles defining a first color and a second container for storing a second supply of marking particles defining a second color. The device further includes a mixing chamber operably associated with the first container and the second container for receiving a least a portion of at least one of the first supply of marking particles and the second supply of marking particles. The device also includes a first metering device operably associated with the first container and the mixing chamber for accurately controlling the quantity of the first supply of marking particles entering the mixing chamber. The device further includes a second metering device operably associated with the second container and the mixing chamber for accurately controlling the quantity of the second supply of marking particles entering the mixing chamber.

In accordance with another aspect of the present invention, there is provided a developer unit for use in an electrophotographic printing machine of the type having an electrostatic latent image recorded on a photoconductive member. The developer unit is adapted for conveying marking particles to the photoconductive member. The developer unit includes a marking particle color blending device for blending a first supply of marking particles defining a first color with a second supply of marking particles defining a second color. The device includes a first container for storing a first supply of marking particles defining a first color and a second container for storing a second supply of marking particles defining a second color. The device further includes a mixing chamber operably associated with the first container and the second container for receiving a least a portion of at least one of the first supply of marking particles and the second supply of marking particles. The device also includes a first metering device operably associated with the first container and the mixing chamber for accurately controlling the quantity of the first supply of marking particles entering the mixing chamber. The device further includes a second metering device operably associated with the second container and the mixing chamber for accurately controlling the quantity of the second supply of marking particles entering the mixing chamber.

In accordance with a further aspect of the present invention, there is provided an electrophotographic printing machine of the type having an electrostatic latent image recorded on a photoconductive member. The printing machine has a developer unit adapted for conveying marking particles to the photoconductive member. The developer unit includes a marking particle color blending device for blending a first supply of marking particles defining a first color with a second supply of marking particles defining a second color. The device includes a first container for storing a first supply of marking particles defining a first color and a second container for storing a second supply of marking particles defining a second color. The device further includes a mixing chamber operably associated with the first container and the second container for receiving a least a portion of at least one of the first supply of marking particles and the second supply of marking particles. The device also includes a first metering device operably associated with the first container and the mixing chamber for accurately controlling the quantity of the first supply of marking particles entering the mixing chamber. The device further includes a second metering device operably associated with the second container and the mixing chamber for accurately controlling the quantity of the second supply of marking particles entering the mixing chamber.

In accordance with yet another aspect of the present invention, there is provided a method for providing custom colored toner to an electrophotographic printing machine of the type having an electrostatic latent image recorded on a photoconductive member. The method includes the steps of providing a first container for storing a supply of a first colored toner, providing a second container for storing a supply of a second colored toner, and accurately mixing within the machine, a portion of the first colored toner with a portion of the second colored toner to form a custom colored toner.

The present invention in intended to alleviate at least some of the aforementioned problems.

BRIEF DESCRIPTION OF THE DRAWINGS

The foregoing and other features of the instant invention will be apparent from a further reading of the specification, claims and from the drawings in which:

While the present invention will be described hereinafter in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

The invention will now be described by reference to a preferred embodiment in a copier/printer. However, it should be understood that the method and apparatus of the present invention could be used with any machine in which custom colors are desired regardless as to whether single component or two component development systems are employed and the tri-level embodiment discussed hereinbelow is exemplary only and is not to be view as limiting the invention in any way.

Figure 3:
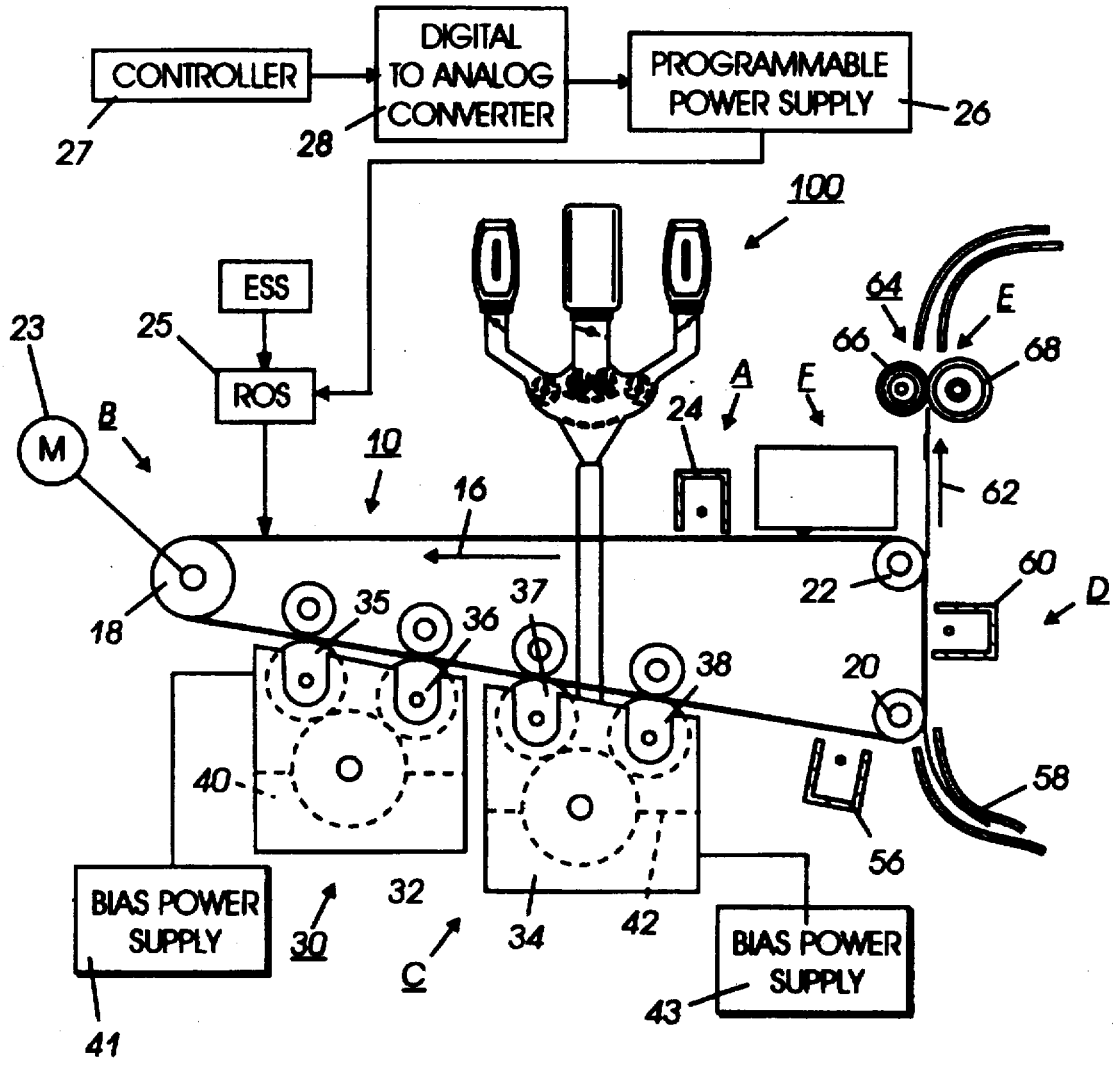
FIG. 3 is a schematic of a printing apparatus utilizing the apparatus of FIG. 1.

As shown in FIG. 3, a printing machine incorporating the present invention may utilize a charge retentive member in the form of a photoconductive belt 10 consisting of a photoconductive surface and an electrically conductive substrate and mounted for movement past a charging station A, an exposure station B, developer stations C, transfer station D and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used as a drive roller and the latter of which can be used to provide suitable tensioning of the photoreceptor belt 10. Motor 23 rotates roller 18 to advance belt 10 in the direction of arrow 16. Roller 18 is coupled to motor 23 by suitable means such as a belt drive.

As can be seen by further reference to FIG. 3, initially successive portions of belt 10 pass through charging station A. At charging station A, a corona discharge device such as a scorotron, corotron or dicorotron indicated generally by the reference numeral 24, charges the belt 10 to a selectively high uniform positive or negative potential, Vo. Preferably, charging is negative. Any suitable control, well known in the art, may be employed for controlling the corona discharge device 24.

Next, the charged portions of the photoreceptor surface are advanced through exposure station B. At exposure station B, the uniformly charged photoreceptor or charge retentive surface 10 is exposed to a laser based input and/or output scanning device 25 which causes the charged retentive surface to be discharged in accordance with the output from the scanning device. Preferably the scanning device is a three level laser Raster Output Scanner (ROS). The ROS output is set via a programmable power supply 26 which driven by means of a controller 27 via a digital to analog converter 28. Alternatively, the ROS could be replaced by a conventional xerographic exposure device.

At development station C, a magnetic brush development system, indicated generally by the reference numeral 30 advances developer materials into contact with the electrostatic latent images. The development system 30 comprises first and second developer housings 32 and 34. Preferably, each magnetic brush development housing includes a pair of magnetic brush developer rollers. Thus, the housing 32 contains a pair of rollers 35, 36 while the housing 34 contains a pair of magnetic brush rollers 37, 38. Each pair of rollers advances its respective developer material into contact with the latent image. Appropriate developer biasing is accomplished via power supplies 41 and 43 electrically connected to respective developer housings 32 and 34.

Color discrimination in the development of the electrostatic latent image is achieved by passing the photoreceptor past the two developer housings 32 and 34 in a single pass with the magnetic brush rolls 35, 36, 37 and 38 electrically biased to voltages which are offset from the background voltage, the direction of offset depending on the polarity of toner in the housing. One housing e.g. 32 (for the sake of illustration, the first) contains developer with black toner 40 having triboelectric properties such that the toner is driven to the most highly charged areas of the latent image by the electrostatic field (development field) between the photoreceptor and the specifically biased development rolls. Conversely, the triboelectric charge on colored toner 42 in the second housing is chosen so that the toner is urged towards parts of the latent image at residual potential by the electrostatic field (development field) existing between the photoreceptor and the development rolls in the second housing at a predetermined bias.

In operation, a sheet of support material 58 is moved into contact with the toner image at transfer station D. The sheet of support material is advanced to transfer station D by a conventional sheet feeding apparatus, not shown. Preferably, the sheet feeding apparatus includes a feed roll contacting the uppermost sheet of a stack of copy sheets. Feed rolls rotate so as to advance the uppermost sheet from the stack into a chute which directs the advancing sheet of support material into contact with photoconductive surface of belt 10 in a timed sequence so that the toner powder image developed thereon contacts the advancing sheet of support material at transfer station D.

Because the composite image developed on the photoreceptor consists of both positive and negative toner, a pretransfer corona discharge member 56 is provided to condition the toner for effective transfer to a substrate using corona discharge.

Transfer station D includes a corona generating device 60 which sprays ions of a suitable polarity onto the backside of sheet 58. This attracts the charged toner powder images from the belt 10 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a backup roller 68. Sheet 58 passes between fuser roller 66 and backup roller 68 with the toner powder image contacting fuser roller 66. In this manner, the toner powder image is permanently affixed to sheet 58. After fusing, a chute guides the advancing sheet 58 to a catch tray (not shown) for subsequent removal from the printing machine by the operator.

After the sheet of support material is separated from photoconductive surface of belt 10, the residual toner particles carried by the non-image areas on the photoconductive surface are removed therefrom. These particles are removed at cleaning station F.

Subsequent to cleaning, a discharge lamp (not shown) floods the photoconductive surface with light to dissipate any residual electrostatic charge remaining prior to the charging thereof for the successive imaging cycle.

Figure 1:
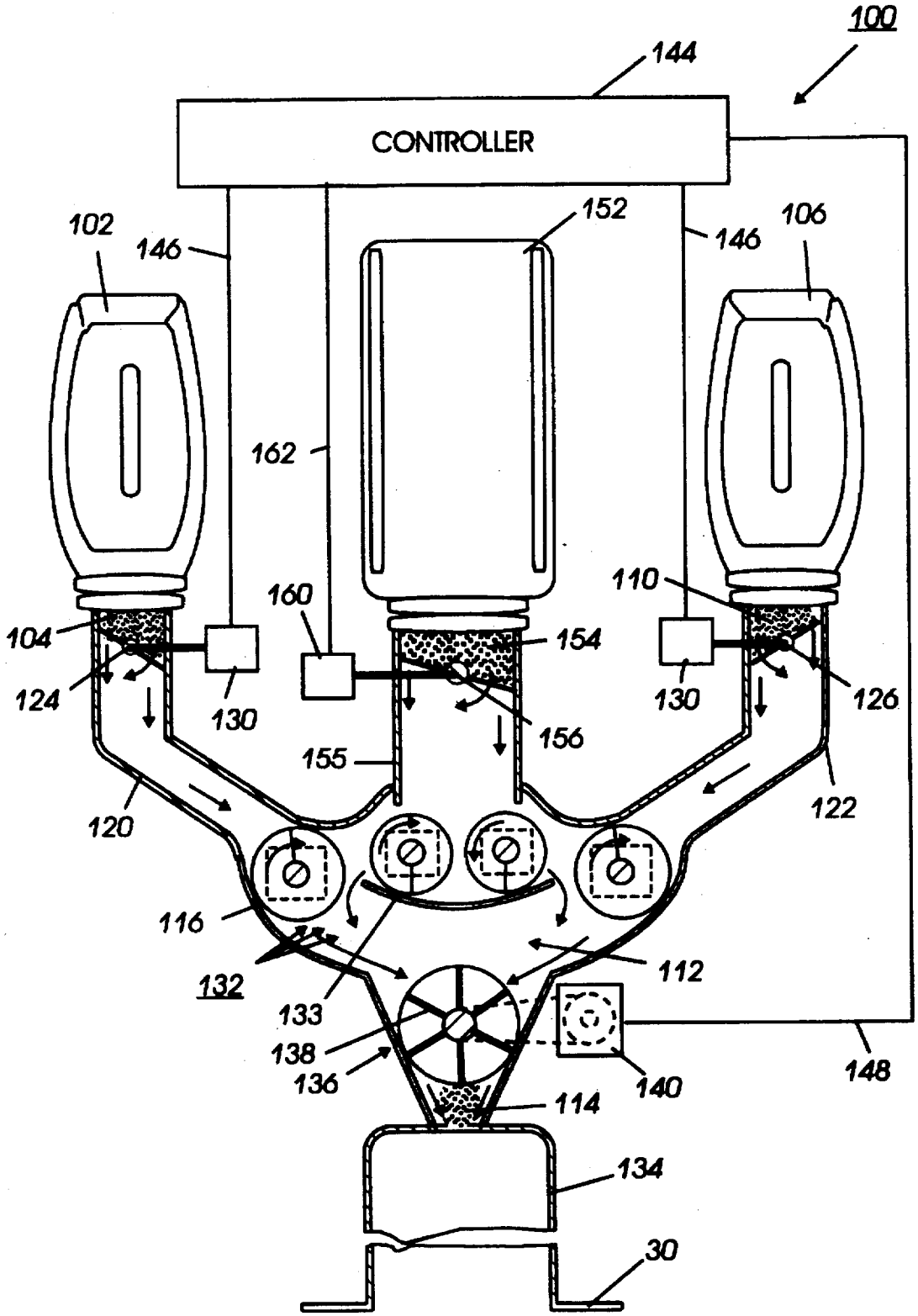
FIG. 1 is a schematic view of an apparatus for the physical mixing of distinct toner to form a custom colored toner according to the present invention.

According to the present invention and referring to FIG. 1, a marking particle color-blending device 100 is shown. The blending device 100 includes a first container 102 for storing a first supply of marking particles 104, as well as a second container 106 for storing a second supply 110 of marking particles. The containers 102 and 106 may be any suitable, durable container for storing the marking particles. For example, the first and second containers 102 and 106 may be made of a metal or a plastic. To reduce cost and complexity, and to also serve as shipping containers, the first and second containers 102 and 106 may be in the form of bottles. The marking particles 104 and 110 may thus be shipped in the bottles 102 and 106, and the bottles then placed within the blending device 100.

In order that the blending device 100 may produce a marking particle of a custom color, the first supply of marking particles 104 and the second supply of marking particles 110 should be marking particles of different colors. For example, the first supply 104 may be one of the subtractive equivalents of the primary additive colors or the process colors,—cyan, magenta, or yellow, and the second supply 110 be one of the remaining process colors—cyan, magenta, or yellow. It should be appreciated, however, that the first supply of marking particles 104 may be either black or of any particular custom color, and the second supply 110 may merely be of a different color.

The marking particle color-blending device 100 also includes a mixing chamber 112 for mixing the first supply 104 of marking particles with the second supply 110 of marking particles to form custom color marking particles 114. The mixing chamber 112 is defined by a mixing chamber housing 116. The housing 116 may be made of any suitable material, for example, a metal or a plastic which is non-reactive with the marking particles. The first container 102 and the second container 106 are operably connected to the mixing chamber by any suitable method, for example, as shown in FIG. 1, by first and second conduits 120 and 122 which are respectively connected to the first container 102 and the second container 106.

Preferably, to regulate the amount of marking particles 104 and marking particles 110 which are fed into the mixing chamber 112, a first metering device 124 meters or controls the amount of first supply 104 of marking particles entering the mixing chamber 112. Likewise, preferably, the amount of the second supply 110 of marking particles entering the mixing chamber 112 is controlled by a second metering device 126. The first and second metering devices 124 and 126 may have any suitable configuration.

For example, the metering devices 124 and 126 may be augers, overlaying plates with apertures, or a gate or butterfly valve. The accuracy in which the particles 104 and 110 are metered into the mixing chamber 112 is critical for the accuracy of he chosen custom color. A gate or butterfly valve may depend on gravity flow of the particles which may not uniformly flow due to caking and other phenomena that affect toner particle flow. The use of a vibrator (not-shown) may assist in the gravitational flow of the particles. Further, more positive metering may be accomplished by replacing the valve with a paddle wheel (not-shown) or foam roller (not-shown) to improve dispensing accuracy.

As shown in FIG. 1, the valves 124 and 126 are in the form of a butterfly valve. The valves 124 and 126 are opened and closed to permit an appropriate amount of marking particles 104 and 110 to pass thereby by gravity. The valves 124 and 126 may be manually opened or, as shown in FIG. 1, include positioning motors 130 which are used to open and close the valves 124 and 126.

To assist the mixing of the first supply 104 and second supply 110 of marking particles in the mixing chamber 112, preferably, the mixing chamber includes a mixer 132 for improving the mixing of the marking particles. The mixing chamber can also include a baffle 133 or chambers (not shown) to assist in the mixing of the particles.

The mixer 132 may be of any suitable configuration. For example, the mixer 132 may be a series of spiral shaped beaters, squirrel-cage shaped wheels, or as shown in FIG. 1, be a series of augers. The augers may rotate in similar or different directions to obtain the optimum mixing of the particles.

Particles mixed in the mixing chamber 112 are fed through discharge chute 134 into the developer unit 38. Preferably, a metering device 136 is positioned between the mixing chamber 112 and the discharge chute 134 to control the amount of custom color particles 114 which are placed deposited in the development system 30. The device 136 closely controls the amount of custom color particles 114 that are placed in the developer system 30 to correspond to the amount of developer particles 114 required to develop the custom color onto a copy substrate to reduce the time and wasted developer when changing from a printing job having a first custom color to a printing job having a second custom color.

The custom color metering device 136 may have any suitable form and may be similar to metering devices 124 and 126. The metering device may also be in the form of a paddle wheel which permits a controlled amount of material to exit between adjacent paddles 138 of the paddle wheel. The paddle wheel may be either rotated manually or, as shown in FIG. 1, include a motor 140.

Preferably, to accurately control the amount of the first supply 104 and second supply 110 of marking particles to obtain a precise color, the blending device 100 includes a controller 144 for controlling the amount of material leaving the first container 102 and the second container 106 to form the custom color marking particles 114. Electrical conduits 146 electrically connect the controller 144 with motors 130 which control the position of the valves 124 and 126, respectively. The controller 144 may also include an electrical conduit 148 which controls the motor 140 for controlling the metering device 136 to control the dispersion of the custom color marking particles 114 into the discharge chute 134.

When utilizing a two-component developer including marking particles and carrier granules, the marking particle color-blending device 100 may also include a third container 152. The third container 152 may include carrier granules 154 which serve to replenish the carrier granules in the development system 30 which have worn or have escaped from the developer system 30. Such granules 154 is also known as replenisher. The granules 154 mix with the marking particles 104 and 110 to form a two-component developer including the carrier granules 154 and the custom color marking particles 114. It should be appreciated that rather than utilizing the third container 154 or in addition thereto, the first container 102 and the second container 106 may include a small quantity of carrier granules 154 mixed with the marking particles therein. The container 152 may be of any suitable shape, may be made of any suitable material, but typically is in the form of a plastic bottle. The third container 152 is operably connected to mixing chamber 112, for example by conduit 155.

Preferably, the carrier granules 154 are precisely metered into the mixing chamber 112 through the use of a metering device 156. The metering device 156 may be in any suitable form, and may be in the form of a butterfly valve 156 similar to valves 124 and 126. The valve 156 may be manually opened or, as shown in FIG. 1, be positioned by motor 160. It should be appreciated that to improve accuracy of the dispensing of the granules a foam roll (not-shown) or a paddle wheel (not-shown) may be used. The motor 160 is preferably controlled by controller 144 and is electrically connected thereto by mean of electrical conduit 162.

Figure 2:
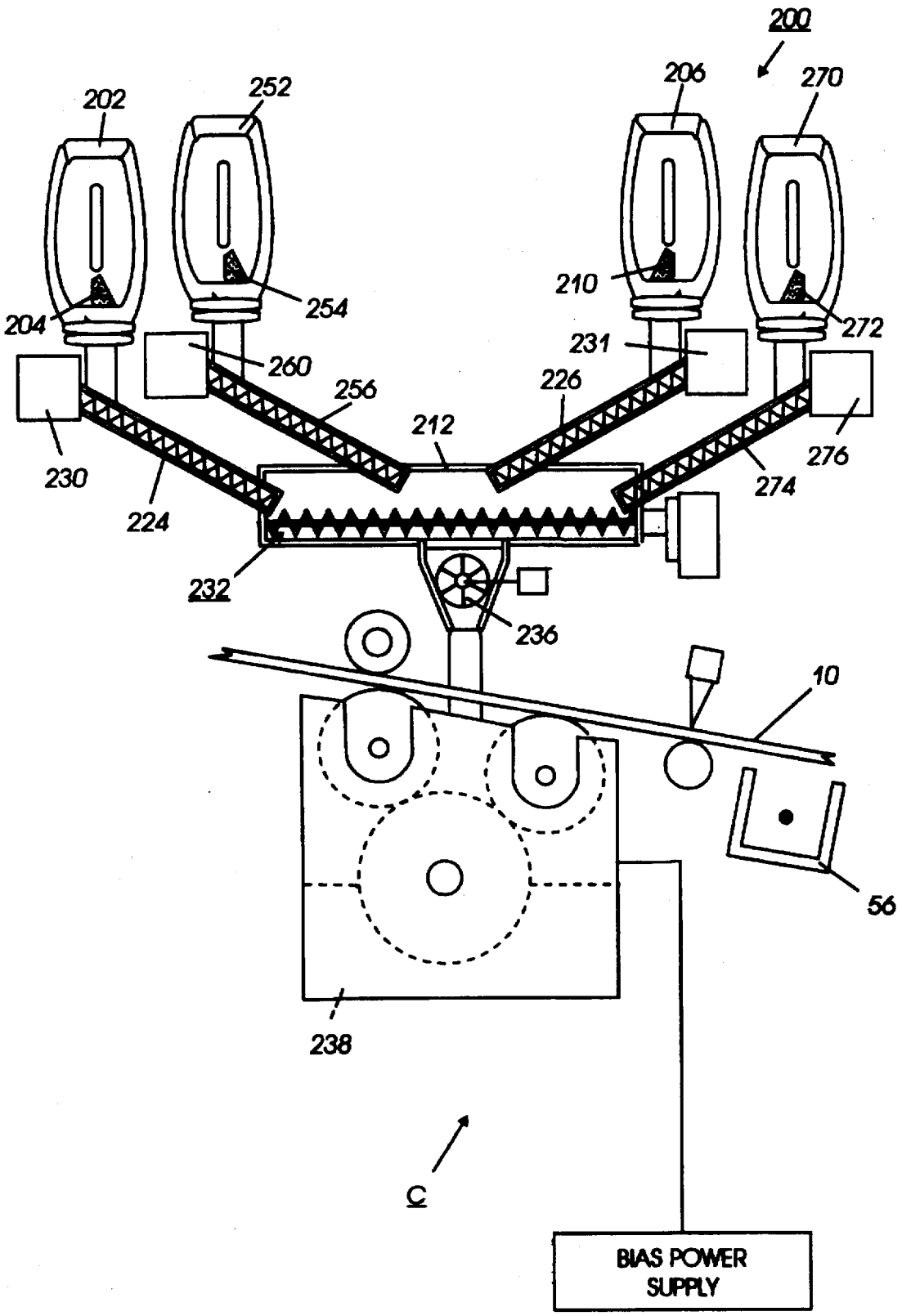
FIG. 2 is a schematic view of an alternate embodiment of an apparatus for the physical mixing of distinct toner to form a custom colored toner according to the present invention.

Referring now to FIG. 2, an alternate embodiment of the blending device according the present invention is shown in blending device 200. Blending device 200 is similar to blending device 100 in that it contains a first container 202 having a supply of first marking particles 204 and second container 206 having a supply of second marking particles 210 similar to the containers 102 and 106 of FIG. 1. To more accurately meter the amount of marking particles entering mixing chamber 212, the container 202 includes a metering device 224 in the form of an auger which is rotated by motor 230. Similarly, marking particles are fed from container 206 by means of a metering device in the form of an auger 226 rotated by motor 231.

To provide for two-component development, the device 200 also includes container 252 for storing carrier granules 254. The carrier granules 254 are dispersed from the container 252 by means of metering device 256 in the form of an auger rotated by motor 260.

Further, in order that a custom color may be provided of any particular color, the device 200 may optionally contain a fourth container 270. Each of the marking particle containers 202, 206, and 270 may contain one of the three subtractive equivalents of the primary colors or the process colors, namely cyan, magenta, and yellow, in order that a custom color of any color may be obtained. The fourth container 270 is similar to the first and second containers 202 and 206. The fourth container 270 contains a third supply of marking particles 272. The marking particles 272 are dispersed to the mixing chamber 212 by a metering device 274 in the form of an auger. The auger is rotated by means of a motor 276.

The marking particles 204, 210, and 272 are mixed with carrier granules 254 in the mixing chamber 212 by means of, for example, a pair of cross-mixing augers 232. A metering device 236, similar to metering device 136 of FIG. 1, is used to disperse particles from the mixing chamber 212 through discharge chute 234 to the developer unit 238. The developer unit 238 is similar to the developer unit 38 of FIG. 3.

It should be appreciated that the blending device 100 and the blending device 200 may be removably secured to the copy machine so that the blending device 100 may be optional equipment for the copy machine.

It should also be appreciated that the blending device 100 may operated independently as a separate blending device. Such a blending device would be of particular value in a printing shop where separate custom colors could be created for unique customer requirements and later placed in a removable toner container for the developing unit or in a removable developer module of a particular copy machine.

By providing a blending device for blending a first supply of marking particles of a first color with a second supply of marking particles of a second color, a custom color can be created instantaneously at low cost.

By providing a marking particle color-blending device having three storage positions, one for each of the subtractive equivalents of the primary colors cyan, magenta, and yellow, a custom color may be simply and inexpensively provided for any color.

By providing a marking particle blending device which operates independently from a machine, a custom color can be provided at a printing shop to correspond with any customer need.

By providing a marking particle blending device to be positioned within a printing machine, a highlight color printing machine can be provided for producing a letterhead with a customer's logo in a custom color on a highlight color machine.

By providing a custom color blending machine including containers for two (2) separate colors, custom colors can be provided at the printing location, obviating the need for a large supply of custom color toner containers.

By providing a custom color blending device including a controller for accurately controlling the dispersion of a first supply and the dispersion of a second supply of marking particles, a very accurate color may be repeatedly provided by the blending device.

By providing a controller to control the amount of marking particles to be mixed to form the custom color, an amount of custom color equaling the machine requirements of the printer may be provided to minimize wasted custom color and to minimize the amount of time necessary to clean the developer unit for use with a different custom color.

While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. A marking particle color blending device for use in an electrophotographic printing machine of the type having an electrostatic latent image recorded on a photoconductive member and having a developer unit including a developer chamber for storing marking particles, said device comprising:

a first container for storing a first supply of marking particles defining a first color;

a second container for storing a second supply of marking particles defining a second color;

a mixing chamber separate from the developer chamber operably associated with said first container and said second container for receiving substantially all of said first supply of marking particles and said second supply of marking particles, said mixing chamber adapted to mix said first supply of marking particles with said second supply of marking particles and adapted to dispense the mixed particles into the developer chamber;

first means operably associated with said first container and said mixing chamber for accurately controlling the quantity of the first supply of marking particles entering said mixing chamber; and second means operably associated with said second container and said mixing chamber for accurately controlling the quantity of the second supply of marking particles entering said mixing chamber.

2. The blending device of claim 1, wherein said first means comprises a metering device operably associated with said first container and said mixing chamber for metering the dispensing of the first supply of marking particles from said first container to said mixing chamber.

3. The blending device of claim 2, wherein said second means comprises a second metering device operably associated with said second container and said mixing chamber for metering the dispensing of the second supply of marking particles from said second container to said mixing chamber.

4. The blending device of claim 3, further comprising a controller operably associated with said first mentioned metering device and with said second metering device for controlling the flow of marking particles from said first container into said mixing chamber and for controlling the flow of marking particles from said second container into said mixing chamber.

5. The blending device of claim 2, wherein said metering device comprises:

a conduit connected to said first container;

an auger located at least partially within said conduit; and a rotating mechanism operably associated with said auger for rotating said auger.

6. The blending device of claim 1, further comprising a mixer operably associated with said mixing chamber for mixing the marking particles dispensed from said first container and said second container.

7. The blending device of claim 1, further comprising a third container for storing a supply of carrier granules, said third container operably associated with said mixing chamber, the supply of carrier granules being mixable in the mixing chamber.

8. A developer unit for use in an electrophotographic printing machine of the type having an electrostatic latent image recorded on a photoconductive member, the developer unit adapted for conveying marking particles to the photoconductive member, the developer unit including a developer chamber for storing marking particles and a marking particle color blending device for blending a first supply of marking particles defining a first color with a second supply of marking particles defining a second color, said device comprising:

a first container for storing the first supply of marking particles;

a second container for storing the second supply of marking particles;

a mixing chamber separate from the developer chamber operably associated with said first container and said second container for receiving substantially all of said first supply of marking particles and said second supply of marking particles, said mixing chamber adapted to mix said first supply of marking particles with said second supply of marking particles and adapted to dispense the mixed particles into the developer chamber;

first means operably associated with said first container and said mixing chamber for accurately controlling the quantity of the first supply of marking particles entering said mixing chamber; and second means operably associated with said second container and said mixing chamber for accurately controlling the quantity of the second supply of marking particles entering said mixing chamber.

9. The developer unit of claim 8, wherein said first means comprises a metering device operably associated with said first container and said mixing chamber for metering the dispensing of the first supply of marking particles from said first container to said mixing chamber.

10. The developer unit of claim 9, wherein said second means comprises a second metering device operably associated with said second container and said mixing chamber for metering the dispensing of the second supply of marking particles from said second container to said mixing chamber.

11. The developer unit of claim 10, further comprising a controller operably associated with said first mentioned metering device and with said second metering device for controlling the flow of marking particles from said first container into said mixing chamber and for controlling the flow of marking particles from said second container into said mixing chamber.

12. The blending device of claim 9, wherein said metering device comprises:

a conduit connected to said first container;

an auger located at least partially within said conduit; and a rotating mechanism operably associated with said auger for rotating said auger.

13. The developer unit of claim 8, further comprising a mixer operably associated with said mixing chamber for mixing the marking particles dispensed from said first container and said second container.

14. The developer unit of claim 8, further comprising a third container for storing a supply of carrier granules, said third container operably associated with said mixing chamber, the supply of carrier granules being mixable in the mixing chamber.

15. A developer unit for use in an electrophotographic printing machine of the type having an electrostatic latent image recorded on a photoconductive member, the developer unit adapted for conveying marking particles to the photoconductive member, the developer unit including a marking particle color blending device for blending a first supply of marking particles defining a first color with a second supply of marking particles defining a second color, said device comprising:

a first container for storing the first supply of marking particles;

a second container for storing the second supply of marking particles;

a mixing chamber operably associated with said first container and said second container for receiving at least a portion of at least one of said first supply of marking particles and said second supply of marking particles, said mixing chamber being quickly disconnectable from said developer unit so that the mixed marking particles may be stored for later use;

first means operably associated with said first container and said mixing chamber for accurately controlling the quantity of the first supply of marking particles entering said mixing chamber; and second means operably associated with said second container and said mixing chamber for accurately controlling the quantity of the second supply of marking particles entering said mixing chamber.

16. An electrophotographic printing machine of the type having an electrostatic latent image recorded on a photoconductive member, the printing machine having a developer unit adapted for conveying marking particles to the photoconductive member, the developer unit including a developer chamber for storing marking particles and a marking particle color blending device for blending a first supply of marking particles defining a first color with a second supply of marking particles defining a second color, said device comprising:

a first container for storing the first supply of marking particles;

a second container for storing the second supply of marking particles;

a mixing chamber separate from the developer chamber operably associated with said first container and said second container for receiving substantially all of said first supply of marking particles and said second supply of marking particles, said mixing chamber adapted to mix said first supply of marking particles with said second supply of marking particles and adapted to dispense the mixed particles into the developer chamber;

first means operably associated with said first container and said mixing chamber for accurately controlling the quantity of the first supply of marking particles entering said mixing chamber; and second means operably associated with said second container and said mixing chamber for accurately controlling the quantity of the second supply of marking particles entering said mixing chamber.

17. The printing machine of claim 16, wherein said first means comprises a metering device operably associated with said first container and said mixing chamber for metering the dispensing of the first supply of marking particles from said first container to said mixing chamber.

18. The printing machine of claim 17, wherein said second means comprises a second metering device operably associated with said second container and said mixing chamber for metering the dispensing of the second supply of marking particles from said second container to said mixing chamber.

19. The printing machine of claim 18, further comprising a controller operably associated with said first mentioned metering device and with said second metering device for controlling the flow of marking particles from said first container into said mixing chamber and for controlling the flow of marking particles from said second container into said mixing chamber.

20. The blending device of claim 17, wherein said metering device comprises:

a conduit connected to said first container;

an auger located at least partially within said conduit; and a rotating mechanism operably associated with said auger for rotating said auger.

21. The printing machine of claim 16, further comprising a mixer operably associated with said mixing chamber for mixing the marking particles dispensed from said first container and said second container.

22. The printing machine of claim 16, further comprising a third container for storing a supply of carrier granules, said third container operably associated with said mixing chamber, the supply of carrier granules being mixable in the mixing chamber.

23. An electrophotographic printing machine of the type having an electrostatic latent image recorded on a photoconductive member, the printing machine having a developer unit adapted for conveying marking particles to the photoconductive member, the developer unit including a marking particle color blending device for blending a first supply of marking particles defining a first color with a second supply of marking particles defining a second color, said device comprising:

a first container for storing the first supply of marking particles;

a second container for storing the second supply of marking particles;

a mixing chamber operably associated with said first container and said second container for receiving at least one of said first supply of marking particles and said second supply of marking particles, said mixing chamber being quickly disconnectable from said printing machine so that the mixed marking particles may be storerd for later use;

first means operably associated with said first container and said mixing chamber for accurately controlling the quanity of the first supply of marking particles entering said mixing chamber; and second means operably associated with said second container and said mixing chamber for accurately controlling the quanity of the second supply of marking particles entering said mixing chamber.

24. A method for providing custom colored toner to an electrophotographic printing machine of the type having an electrostatic latent image recorded on a photoconductive member and a developer unit including a developer chamber for storing toner, said method comprising the steps of:

providing a first container for storing a supply of a first colored toner;

providing a second container for storing a supply of a second colored toner;

providing a mixing chamber for receiving the supply of a first colored toner and the supply of a second colored toner;

accurately mixing within the mixing chamber, the first colored toner with the second colored toner to form a custom colored toners;

dispensing the custom colored toner into the developer chamber.

* * * * *